US010550350B2

(12) United States Patent
Bell et al.

(10) Patent No.: US 10,550,350 B2
(45) Date of Patent: Feb. 4, 2020

(54) BOROXINE BASED SEAL COMPATIBILITY AGENTS

(71) Applicant: Afton Chemical Corporation, Richmond, VA (US)

(72) Inventors: Jason Richard Bell, Powhatan, VA (US); Carl W. Bennett, Glen Allen, VA (US)

(73) Assignee: AFTON CHEMICAL CORPORATION, Richmond, VA (US)

( * ) Notice: Subject to any disclaimer, the term of this patent is extended or adjusted under 35 U.S.C. 154(b) by 0 days.

(21) Appl. No.: 15/762,975

(22) PCT Filed: Nov. 10, 2016

(86) PCT No.: PCT/US2016/061371

§ 371 (c)(1),
(2) Date: Mar. 23, 2018

(87) PCT Pub. No.: WO2017/083548

PCT Pub. Date: May 18, 2017

(65) Prior Publication Data

US 2019/0106646 A1 Apr. 11, 2019

Related U.S. Application Data

(60) Provisional application No. 62/254,016, filed on Nov. 11, 2015.

(51) Int. Cl.
*C10M 163/00* (2006.01)
*C10M 139/00* (2006.01)

(52) U.S. Cl.
CPC .... *C10M 139/00* (2013.01); *C10M 2227/062* (2013.01); *C10N 2230/36* (2013.01); *C10N 2230/40* (2013.01); *C10N 2240/04* (2013.01); *C10N 2240/10* (2013.01); *C10N 2240/102* (2013.01); *C10N 2240/103* (2013.01); *C10N 2260/12* (2013.01); *C10N 2260/14* (2013.01); *C10N 2270/00* (2013.01)

(58) Field of Classification Search
CPC ..... C10M 139/00; C10M 2201/087
USPC ..... 508/186
See application file for complete search history.

(56) References Cited

U.S. PATENT DOCUMENTS

| | | | | |
|---|---|---|---|---|
| 3,410,913 | A | 11/1968 | McMahon et al. | |
| 4,211,679 | A | 7/1980 | Mark et al. | |
| 4,450,087 | A | 5/1984 | Askew et al. | |
| 5,169,547 | A | 12/1992 | Farng et al. | |
| 6,335,423 | B1 | 1/2002 | Varma | |
| 2002/0147116 | A1* | 10/2002 | Carrick | C10M 139/00 508/198 |
| 2005/0009712 | A1 | 1/2005 | Erdemir | |
| 2014/0106996 | A1 | 4/2014 | DeSantis et al. | |

FOREIGN PATENT DOCUMENTS

| | | | |
|---|---|---|---|
| EP | 0500317 | A2 | 8/1992 |
| WO | 1986006092 | A1 | 10/1986 |

OTHER PUBLICATIONS

European Search Report, dated Jul. 11, 2018 for EP Application No. 16865021.6.

Lappert, M. F. "Organic compounds of boron." Chemical Reviews 56.5 (1956): 959-1064.

International Search Report and Written Opinion, dated Feb. 22, 2017 for PCT Application No. PCT/US2016/061371.

Invitation to Respond to Written Opinion for corresponding Singapore Application No. 11201803638Q, dated Aug. 22, 2019.

* cited by examiner

*Primary Examiner* — Prem C Singh
*Assistant Examiner* — Francis C Campanell
(74) *Attorney, Agent, or Firm* — Mendelsohn Dunleavy, P.C.

(57) ABSTRACT

The present invention generally relates to compositions for use in lubricating oils. In certain aspects, the present invention is generally directed to boroxine compounds having alkyl groups where one or more of the alkyl groups contains at least 8 carbon atoms. Such compounds may present improved hydrolytic stability, compared to other boroxine compounds. Such boroxine compounds may be used, for example, to improve seal compatibility in an engine. Other aspects of the invention are generally directed to systems and methods for making such boroxine compounds, engine oils containing such boroxine compounds, methods of using such boroxine compounds, or the like.

19 Claims, No Drawings

BOROXINE BASED SEAL COMPATIBILITY AGENTS

RELATED APPLICATIONS

This application claims the benefit of U.S. Provisional Patent Application Ser. No. 62/254,016, filed Nov. 11, 2015, entitled "Boroxine Based Seal Compatibility Agents," incorporated herein by reference in its entirety.

FIELD

The present invention generally relates to compositions for use in lubricating oils.

BACKGROUND

Boroxines are a 6-membered, heterocyclic compound composed of alternating oxygen and singly-hydrogenated boron atoms. The oxygen atoms may be bonded to various alkyl groups. Boroxines may be used, for example, within lubricating oils to improve various performance characteristics, such as reducing the ability of certain amine compounds from attacking fluoropolymer seals within engines. However, such compounds are often hydrolytically sensitive, and thus, improved boroxine compounds are needed.

SUMMARY

The present invention generally relates to compositions for use in lubricating oils. The subject matter of the present invention involves, in some cases, interrelated products, alternative solutions to a particular problem, and/or a plurality of different uses of one or more systems and/or articles.

In one aspect, the present invention is generally directed to a composition. In some embodiments, the composition comprises a structure:

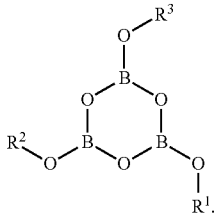

Each of $R^1$, $R^2$, and $R^3$ may be independently an alkyl group. In some cases, $R^1$ comprises at least 8 carbon atoms.

The present invention, in another aspect, is generally directed to a lubricating oil composition. In one set of embodiments, the composition comprises a base oil, and a composition comprising a structure:

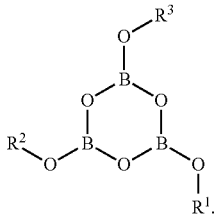

In some instances, each of $R^1$, $R^2$, and $R^3$ is independently an alkyl group. In one embodiment, $R^1$ comprises at least 8 carbon atoms.

In accordance with another aspect, the present invention is generally directed to a method. In one set of embodiments, the method comprises reacting orthoboric acid with a trialkyl borate to produce an alkoxyboroxine. In some embodiments, at least one alkyl within the trialkyl borate comprises at least 8 carbon atoms.

In another aspect, the present invention encompasses methods of making one or more of the embodiments described herein, for example, alkoxyboroxines having at least one alkyl having at least 8 carbon atoms. In still another aspect, the present invention encompasses methods of using one or more of the embodiments described herein, for example, alkoxyboroxines having at least one alkyl having at least 8 carbon atoms.

Other advantages and novel features of the present invention will become apparent from the following detailed description of various non-limiting embodiments of the invention. In cases where the present specification and a document incorporated by reference include conflicting and/or inconsistent disclosure, the present specification shall control. If two or more documents incorporated by reference include conflicting and/or inconsistent disclosure with respect to each other, then the document having the later effective date shall control.

DETAILED DESCRIPTION

The present invention generally relates to compositions for use in lubricating oils. In certain aspects, the present invention is generally directed to boroxine compounds having alkyl groups where one or more of the alkyl groups contains at least 8 carbon atoms. Such compounds may present improved hydrolytic stability, compared to other boroxine compounds. Such boroxine compounds may be used, for example, to improve seal compatibility in an engine. Other aspects of the invention are generally directed to systems and methods for making such boroxine compounds, engine oils containing such boroxine compounds, methods of using such boroxine compounds, or the like.

One aspect of the present invention is generally directed to alkoxyboroxine compounds having the following structure:

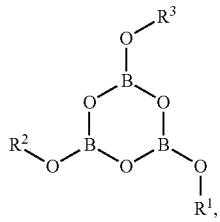

where each of $R^1$, $R^2$, and $R^3$ is independently an alkyl group. The alkyl group may be substituted or unsubstituted, and may be straight or branched. In some cases, the alkyl group may contain 8 or more carbon atoms. For instance, the alkyl group may contain 8, 9, 10, 11, 12, 13, 14, 15, 16, or more carbon atoms. These may be arranged in a straight chain (e.g., an n-alkyl), or there may be one or more side chains in the alkyl group. Each of $R^1$, $R^2$, and $R^3$ may independently have the same or different structures, and in some embodiments, $R^1$, $R^2$, and $R^3$ may each independently have 8 or more carbon atoms. In some cases, the composition is free of a sterically hindered amine compound. Without wishing to be bound by any theory, it is believed that such compounds may have improved hydrolytic stability, e.g., due to the presence of the alkyl groups, which may impart more hydrophobicity to the compound, thereby generally repelling water and reducing hydrolytic reactions. Alkyl groups with shorter chains (e.g., 7 or fewer carbon atoms) may exhibit lower stability or hydrophobicity.

The boroxine compounds may be prepared using a variety of different techniques. In one example, orthoboric acid ($H_3BO_3$) with a trialkyl borate to produce the alkoxyboroxine compounds. The trialkyl borate may have three substantially identical alkyl groups, e.g., if alkoxyboroxine compounds having a single R group (e.g., n-dodecyl) is desired. In some cases, however, more than one trialkyl borate may be used, for instance, if a variety of alkoxyboroxine compounds having various R groups is desired. The trialkyl borates may be synthesized or obtained commercially. For instance, in some embodiments, trialkyl borates may be prepared by borating long chain alcohols (e.g., alkanols) such that the alkyl groups from the alkanols form the alkyl portions of the trialkyl borate compounds at a suitable mole ratio. In addition, other methods can be used to produce the alkoxyboroxine compounds, e.g., by using a boronated dispersant.

In some cases, such boroxine compounds may be useful, for example, to improve the performance of dispersants in a static seals test against FKM elastomers. FKM elastomers are generally polymers containing at least about 80% fluoroelastomers, as defined in ASTM D1418. FKM elastomers may be copolymers, terpolymers, tetrapolymers, etc. However, when exposed to dispersants within oils such as engine oils, such elastomers may degrade. Without wishing to be bound by any theory, it is believed that the presence of boroxine compounds such as those discussed herein may improve the resistance of elastomers to degradation when exposed to such dispersants.

Such boroxine compounds may be used, for example, as an additive to an oil, e.g., a base oil or an oil of lubricating viscosity, for applications such as engine oil or the like. In some cases, such boroxine compounds may be useful, for example, to improve seal compatibility. Accordingly, another aspect of the present invention is generally directed to a lubricating oil composition containing an oil of lubricating viscosity, and a boroxine compound such as those described herein. Such lubricating oil compositions can be used, for example, in engines such as gasoline engines, heavy-duty diesel engines, natural gas engines, etc., or for other applications such as pistons (e.g., aviation pistons), automatic transmission fluids, for gear lubrication, or the like.

Such compositions can be prepared, for instance, by mixing a boroxine compound with the oil of lubricating viscosity using any suitable technique, e.g., to produce a lubricant composition. The boroxine compound may be included in the lubricant composition in an amount sufficient to provide a desired concentration of boron in the lubricant composition. In some embodiments, the amount of boroxine compounds that may be present at at least about 0.01 wt %, at least about 0.03 wt %, at least about 0.05 wt %, at least about 0.1 wt %, at least about 0.3 wt %, at least about 0.5 wt %, at least about 1 wt %, at least about 3 wt %, at least about 5 wt %, at least about 10 wt %, at least about 15 wt %, at least about 20 wt %, at least about 25 wt %, at least about 30 wt %, at least about 35%, or at least about 40%. In certain cases, the amount of boroxine compound may be present at no more than about 50 wt %, no more than about 45 wt %, no more than about 40 wt %, no more than about 35 wt %, no more than about 30 wt %, no more than about 25 wt %, no more than about 20 wt %, no more than about 10 wt %, no more than about 5 wt %, no more than about 2 wt %, or no more than about 1%, etc. Combinations of any of any of these are also possible in certain embodiments. For instance, the boroxine compound may be present in an amount of between about 0.01 wt % and about 40 wt %, or between about 0.1 wt % and about 20 wt %.

As another example, the boroxine compound can be included in an amount sufficient to provide from 1 to 5000 ppm boron in the lubricant composition based on the total weight of the lubricant composition. In some cases, the boroxine compound may be included in an amount in the lubricant composition sufficient to provide from 100 to 5000, 300 to 3000, 500 to 1500, or 700 to 1200, ppm boron, in the lubricant composition based the total weight of the lubricant composition. In certain embodiments, the boroxine compound may be provided in an amount sufficient to provide from 1 to 100, 1 to 40, 1 to 20, or to 20, ppm boron, in the lubricant composition based on the total weight of the lubricant composition. In some embodiments, the boroxine compound may be present in the lubricant composition in an amount ranging from 0.1 to 10, 0.1 to 5, 0.1 to 1, 0.3 to 0.7, 0.5 to 3, or 0.5 to 1.5, wt. %, based on the total weight of the lubricant composition. In other embodiments, the boroxine compound is included in an amount greater than 1 wt %, but less than 5 wt %, based on the total weight of the lubricant composition. Mixtures of different boroxine compounds may also be used in combination in the lubricant composition.

The oil of lubricating viscosity for use in the lubricating oil compositions, also referred to as a base oil, is typically present in a major amount, e.g., an amount of greater than about 50 wt %, greater than about 55 wt %, greater than about 60 wt %, greater than about 65 wt %, greater than about 70 wt %, greater than about 75 wt %, greater than about 80 wt %, greater than about 85 wt %, greater than about 90 wt %, greater than about 95 wt %, greater than about 97 wt %, greater than about 98 wt %, greater than about 99 wt %, greater than about 99.5 wt %, etc., based on the total weight of the composition.

A base oil can include a base stock or blend of base stocks which is a lubricant component that is produced by a single manufacturer (or more than one manufacturer) to the same specifications (independent of feed source or manufacturer's location); that meets the same manufacturer's specification; and that is identified by a unique formula, product identification number, or both. Examples of base oils include, but are not limited to, engine oils, marine cylinder oils, functional fluids such as hydraulic oils, gear oils, transmission fluids, etc. Specific non-limiting examples include lubricating oil compositions having an SAE Viscosity Grade of 0 W, 0 W-20, 0 W-30, 0 W-40, 0 W-50, 0 W-60, 5 W, 5 W-20, 5 W-30, 5 W-40, 5 W-50, 5 W-60, 10 W, 10 W-20, 10 W-30, 10 W-40, 10 W-50, 15 W, 15 W-20, 15 W-30, or 15 W-40.

Base stocks may be manufactured using a variety of different processes including, but not limited to, distillation, solvent refining, hydrogen processing, oligomerization, esterification, and rerefining. The base oil of the lubricating oil compositions may include any natural or synthetic lubricating base oil.

Suitable base oil includes base stocks obtained by isomerization of synthetic wax and slack wax, as well as hydrocracked base stocks produced by hydrocracking (rather than solvent extracting) the aromatic and polar components of the crude.

Natural oils include animal oils and vegetable oils (e.g., rapeseed oils, castor oil, lard oil); liquid petroleum oils and hydro-refined, solvent-treated or acid-treated mineral oils or the paraffinic naphthenic and mixed paraffinic-naphthenic types. Oils of lubricating viscosity derived from coal or shale also may be used as base oils. Other examples of natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, etc.

Synthetic lubricating oils include hydrocarbon oils and halo-substituted hydrocarbon oils such as polymerized and interpolymerized olefins, alkylbenzenes; polyphenyls; and alkylated diphenyl ethers and alkylated diphenyl sulfides and derivative, analogs and homologs thereof. Additional examples of synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof; alkylbenzenes such as dodecylbenzenes, tetradecylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like. Alkylene oxide polymers, and interpolymers and derivatives thereof where the terminal hydroxyl groups have been modified by esterification, etherification, etc., are additional examples of synthetic lubricating oil. Still other examples of synthetic lubricating oils are the esters of dicarboxylic acids with a variety of alcohols (e.g., butyl alcohol, hexyl alcohol, dodecyl alcohol, 2-ethylhexyl alcohol, ethylene glycol, diethylene glycol monoether, propylene glycol).

The oil may comprise a Group I, Group II, Group II, Group IV or Group V oil or blends of the aforementioned oils. The diluent oil may also comprise a blend of one or more Group I oils and one or more of Group II, Group III, Group IV or Group V oil. For example, the diluent oil is a mixture of a Group I oil and one or more a Group II, Group III, Group IV or Group V oil, or a mixture of a Group I oil and one or more Group II or Group III oil. Definitions for the oils as used herein are the same as those found in the American Petroleum Institute (API) publication "Engine Oil Licensing and Certification System," Industry Services Department, Fourteenth Edition, December 1996, Addendum 1, December 1998.

The lubricating oil may be derived from unrefined, refined, and rerefined oils, either natural, synthetic, or mixtures of two or more of any of these of the types disclosed herein. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils can be obtained by treating used oils in processes similar to those used to obtain refined oils.

In some embodiments, the base oil may contain one or more other additives, such as an antioxidant, an anti-wear agent, a detergent, a rust inhibitor, a demulsifying agent, a metal deactivating agent, a friction modifier, a pour point depressant, an anti-foaming agent, a solvent, a corrosion inhibiter, and/or an ashless dispersant. Other additives can also be used in various embodiments. A variety of potential additives are readily available commercially. These additives, or their analogous compounds, can be employed for the preparation of lubricating oil compositions, for instance by the usual blending procedures.

Examples of antioxidants include, but are not limited to, aminic types, e.g., diphenylamine, phenyl-alpha-napthylamine, N,N-di(alkylphenyl) amines; and alkylated phenylene-diamines; phenolics such as, for example, BHT, sterically hindered alkyl phenols such as 2,6-di-tert-butylphenol, 2,6-di-tert-butyl-p-cresol and 2,6-di-tert-butyl-4-(2-octyl-3-propanoic) phenol; and mixtures thereof.

Examples of antiwear agents include, but are not limited to, zinc dialkyldithiophosphates and zinc diaryldithiophosphates, aryl phosphates and phosphites, sulfur-containing esters, phosphosulfur compounds, metal or ash-free dithiocarbamates, xanthates, alkyl sulfides and the like and mixtures thereof.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Combinations of detergents, whether overbased or neutral or both, may be used.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives. The oil soluble sulfonates or alkaryl sulfonic acids may be neutralized with oxides, hydroxides, alkoxides, carbonates, carboxylate, sulfides, hydrosulfides, nitrates, borates and ethers of the metal. Metal salts of phenols and sulfurized phenols are prepared by reaction with an appropriate metal compound such as an oxide or hydroxide and neutral or overbased products may be obtained by methods well known in the art.

Examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof.

Examples of a demulsifying agent include, but are not limited to, anionic surfactants (e.g., alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and the like and combinations thereof.

Examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines.

Examples of a pour point depressant include, but are not limited to, polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In one embodiment, a pour point depressant comprises an ethylene-vinyl acetate copolymer, a condensate of chlorinated paraffin and phenol, polyalkyl styrene and the like and combinations thereof.

Examples of antifoaming agents include, but are not limited to, polymers of alkyl methacrylate; polymers of dimethylsilicone and the like and mixtures thereof.

Examples of a corrosion inhibitor include, but are not limited to, half esters or amides of dodecylsuccinic acid, phosphate esters, thiophosphates, alkyl imidazolines, sarcosines and the like and combinations thereof.

Ashless dispersant compounds are generally used to maintain in suspension insoluble materials resulting from oxidation during use, thus preventing sludge flocculation and precipitation or deposition on metal parts. Dispersants may also function to reduce changes in lubricating oil viscosity by preventing the growth of large contaminant particles in the lubricant. An ashless dispersant generally comprises an oil soluble polymeric hydrocarbon backbone having functional groups that are capable of associating with particles to be dispersed.

In one embodiment, an ashless dispersant is one or more basic nitrogen-containing ashless dispersants. Basic nitrogen-containing ashless dispersants include hydrocarbyl succinimides; hydrocarbyl succinamides; mixed ester/amides of hydrocarbyl-substituted succinic acids formed by reacting a hydrocarbyl-substituted succinic acylating agent stepwise or with a mixture of alcohols and amines, and/or with amino alcohols; Mannich condensation products of hydrocarbyl-substituted phenols, formaldehyde and polyamines; and amine dispersants formed by reacting high molecular weight aliphatic or alicyclic halides with amines, such as polyalkylene polyamines.

Examples of ashless dispersants include, but are not limited to, amines, alcohols, amides, or ester polar moieties attached to the polymer backbones via bridging groups. An ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine.

Each of the foregoing additives, when used, is used at a functionally effective amount to impart the desired properties. Thus, for example, if an additive is a friction modifier, a functionally effective amount of this friction modifier would be an amount sufficient to impart the desired friction modifying characteristics to the lubricant. Generally, the concentration of each of these additives, when used, ranges from about 0.001% to about 20% by weight, and in one embodiment about 0.01% to about 10% by weight based on the total weight of the lubricating oil composition.

U.S. Provisional Patent Application Ser. No. 62/254,016, filed Nov. 11, 2015, entitled "Boroxine Based Seal Compatibility Agents," is incorporated herein by reference in its entirety.

The following examples are intended to illustrate certain embodiments of the present invention, but do not exemplify the full scope of the invention.

EXAMPLES

This example illustrates long chain alkoxyboroxines which have shown ability to improve the performance of dispersants in a static seals test against FKM elastomers. See ASTM D1418. A lauryl alcohol (approximately C12) version of boroxine was synthesized as follows:

To a 500 mL round bottom flask equipped with a dean stark apparatus, and under nitrogen, was charged 200 mL toluene. To this was added 1 mole of boric acid. At 70° C., 1 mole of lauryl alcohol was added in one portion and the reaction mixture was then heated to reflux. The reaction mixture was kept refluxing for at least 4 hours and 2 moles of water were collected. The dean stark trap was replaced with a short path distillation head, and toluene was removed by distillation. Once the solvent was removed, the reaction mixture continued to dry by pulling 28 mmHg vacuum for 2 hours while increasing temperature to 140° C. Once the 2-hour hold was achieved, the product (Product 1) was removed from heat and transferred to an air-tight container. The yield was 93-98%.

Another example was prepared by the same method as above, except that the boric acid:lauryl alcohol ratio was 3:2. In that product, two boron atoms were alkylated.

FKM static seal compatibility has been a difficult test for HDD, PCMO, Industrial Gear and Axle since inception. Amines and amine containing dispersant are known to deteriorate the FKM elastomer, therefore amine heavy formulations tend to have more trouble.

In this example, a lauryl alcohol (approximately C12) version of boroxine (Product 1) was evaluated in a static seal test.

Static Seal Testing. All oil solution samples used Motiva Star 4 as the base oil in these experiments. Static seal tests were performed using Type 2 FKM (VDF/HFP/TFE copolymer, Bisphenol AF cured) fluoroelastomer samples (SAE J2643 Standard Reference Material FKM-1) for all samples, and AK6 fluoroelastomer for HDEO and PCMO, 75 FKM 585 for Industrial Gear Oil, and ISO 13662 SRE FKM-2 for Automotive Axle. The fluoroelastomer sheets were cut into dogbones, and subsequently soaked in oil solutions for a specified length of time at 130° C., 150° C., or 163° C., depending on the SBU relevant specifications (ASTM methods for EO and auto axle). Three dogbones were soaked in each fluid, with tensile strength (TS), elongation at break (E@B), and hardness (ΔH) reported as an average of each of the three test results. An additional elastomer coupon was tested for volume change measurements. The results were shown in Table 1 below:

TABLE 1

| Sample | formulation | seal material | ppm B From Boroxine | E@B | TS | ΔH |
|---|---|---|---|---|---|---|
| 1 | HDD DI package* | J2643 | 0 | −53.15 | −52.98 | 2.9 |
| 2 | HDD DI package* | J2643 | 450 | −44.88 | −48.20 | 1.0 |
| 3 | HDD DI package* | J2643 | 900 | −33.90 | −39.11 | 0.5 |
| 4 | HDD DI package* | AK6 | 0 | −68.71 | −60.40 | 2.3 |
| 5 | HDD DI package* | AK6 | 300 | −60.00 | −52.74 | 0.9 |
| 6 | HDD DI package* | AK6 | 900 | −49.60 | −39.27 | 0.0 |
| 7 | Gear Oil package** | J2643 | 0 | −30.82 | −40.77 | −2.0 |
| 8 | Gear Oil package** | J2643 | 254 | −7.74 | −17.34 | 0.2 |
| 9 | Gear Oil package** | AK6 | 0 | −46.95 | −40.08 | −2.6 |
| 10 | Gear Oil package** | AK6 | 254 | −26.19 | −19.75 | −0.9 |
| 11 | PCMOO DI package*** | J2643 | 0 | −32.45 | −39.86 | 1.0 |
| 12 | PCMO DI package*** | J2643 | 150 | −20.16 | −27.25 | 0.6 |
| 13 | PCMO DI package** | J2643 | 450 | −5.53 | −19.83 | 0.9 |
| 14 | PCMO DI package*** | AK6 | 0 | −37.20 | −31.29 | −0.4 |
| 15 | PCMO DI package*** | AK6 | 450 | −19.22 | −15.12 | −0.1 |

*Commercial heavy duty diesel DI package available from Afton Chemical Corp.
**Commercial Gear Oil package available from Afton Chemical Corp.
***Commercial PCMO DI package available from Afton Chemical Corp.

In addition, different phosphorylated or boronated dispersants with or without boroxine were tested for seal compatibility. The results are show in Table 2 below:

TABLE 2

| Sample | Seal material | B ppm | P ppm | E@B | TS | ΔH |
|---|---|---|---|---|---|---|
| phosporylated dispersant with Boroxine | J2643 | 550 | 400 | −6.53 | −14.97 | −2.63 |
| Phosphorylated and boronated without boroxine | J2643 | 200 | 450 | −33.57 | −36.94 | 1.74 |
| Phosphorylated without boroxine | J2643 | 0 | 380 | −34.49 | −39.72 | −0.8 |
| Boronated without boroxine | J2643 | 750 | 0 | −27.78 | −30.76 | −2.8 |

The boroxine showed superior ability to improve seals performance. The boroxine can be used in an additive for seal control, and can be added to any formulation. In addition, the boroxine can be generated in situ in a boronated dispersant. For instance, if boroxine is generated in situ by adding an alcohol during boronation in the proper mole ratio, boroxine may be prepared within the oil, which could be used to improve seal compatibility, i.e., as compared to a formulation without the boroxine.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When the word "about" is used herein in reference to a number, it should be understood that still another embodiment of the invention includes that number not modified by the presence of the word "about."

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A composition, comprising a) one or more compounds having a structure:

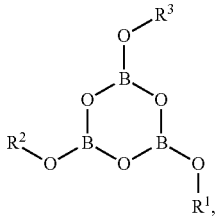

wherein each of $R^1$, $R^2$, and $R^3$ is independently an alkyl group, and $R^1$ has 12 carbon atoms, and said one or more compounds are present in an amount to provide from 100 ppm to 5000 ppm of boron to the composition; and b) a dispersant; and the composition provides improved seal compatibility for static seals containing at least 80% fluoroelastomers, as measured by ASTM D1418, relative to a composition absent compounds of the structure.

2. The composition of claim 1, wherein each of $R^2$, and $R^3$ independently comprises at least 8 carbon atoms.

3. The composition of claim 1, wherein each of $R^2$, and $R^3$ independently has 8 to 16 carbon atoms.

4. The composition of claim 1, wherein each of $R^1$, $R^2$, and $R^3$ has 12 carbon atoms.

5. The composition of claim 1, wherein $R^1$ is n-dodecyl.

6. The composition of claim 1, wherein each of $R^1$, $R^2$, and $R^3$ is n-dodecyl.

7. The composition of claim 1, wherein the composition is free of a sterically hindered amine compound.

8. A lubricating oil composition, comprising:

a base oil; and a composition, comprising:

a) one or more compounds having a structure:

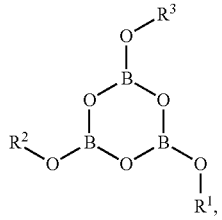

wherein each of $R^1$, $R^2$, and $R^3$ is independently an alkyl group, and $R^1$ comprises at least 8 carbon atoms, and said one or more compounds are present in an amount to provide from 100 ppm to 5000 ppm of boron to the lubricating oil composition; and b) a dispersant, and the lubricating oil composition provides improved seal compatibility for static seals containing at least 80% fluoroelastomers as measured by ASTM D1418, relative to a lubricating oil composition absent compounds of the structure.

9. The composition of claim 8, wherein each of $R^1$, $R^2$, and $R^3$ independently comprises at least 8 carbon atoms.

10. The composition of claim 8, wherein each of $R^1$, $R^2$, and $R^3$ independently has 8 to 16 carbon atoms.

11. The composition of claim 8, wherein $R^1$ has 12 carbon atoms.

12. The composition of claim 8, wherein each of $R^1$, $R^2$, and $R^3$ has 12 carbon atoms.

13. The composition of claim 8, wherein $R^1$ is n-dodecyl.

14. The composition of claim 8, wherein each of $R^1$, $R^2$, and $R^3$ is n-dodecyl.

15. The composition of claim 8, wherein the composition is free of a sterically hindered amine compound.

16. A method for improving seal compatibility, comprising:

operating an engine comprising a lubricating oil composition comprising:

a base oil; and a composition, comprising:

a) one or more compounds having a structure:

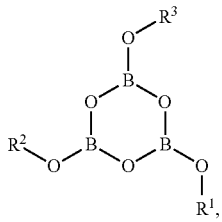

wherein each of $R^1$, $R^2$, and $R^3$ is independently an alkyl group, and $R^1$ comprises at least 8 carbon atoms, and the one or more compounds are present in an amount to provide from 100 ppm to 5000 ppm of boron to the lubricating oil composition; and b) a dispersant, and the method provides improved seal compatibility for static seals containing at least 80% fluoroelastomers as measured by ASTM D1418, relative to a method using a lubricating oil composition absent compounds of the structure.

17. A method, comprising:

operating an engine comprising a lubricating oil composition of claim 13.

18. The composition of claim 10, wherein $R^1$ is n-dodecyl.

19. The composition of claim 3, wherein $R^1$ is n-dodecyl.

* * * * *